US008572917B2

(12) United States Patent
Gartz et al.

(10) Patent No.: US 8,572,917 B2
(45) Date of Patent: Nov. 5, 2013

(54) UNDERLAYMENT WITH IMPROVED DRAINAGE

(75) Inventors: Mark R. Gartz, Mt. Prospect, IL (US); John W. Lubker, II, Norcross, GA (US); Douglas S. Nordgren, Gore, VA (US); Peter James Everett, Collinsville, CT (US)

(73) Assignee: PACTIV LLC, Lake Forest, IL (US)

( * ) Notice: Subject to any disclaimer, the term of this patent is extended or adjusted under 35 U.S.C. 154(b) by 1261 days.

(21) Appl. No.: 11/837,318

(22) Filed: Aug. 10, 2007

(65) Prior Publication Data

US 2008/0034690 A1 Feb. 14, 2008

Related U.S. Application Data

(60) Provisional application No. 60/837,106, filed on Aug. 11, 2006.

(51) Int. Cl.
*E04F 17/00* (2006.01)

(52) U.S. Cl.
USPC ..... 52/302.3; 52/309.4; 52/169.145; 52/741.3

(58) Field of Classification Search
USPC ..... 52/302.1–302.7, 309.4, 408, 210, 52/169.5, 169.11, 169.14, 416, 409, 450, 52/453, 741.3, 553, 741.4; 405/36; 4/656, 4/637
See application file for complete search history.

(56) References Cited

U.S. PATENT DOCUMENTS 3,426,487 A 2/1969 Forte
3,563,038 A * 2/1971 Healy et al. ..... 405/45
3,598,164 A 8/1971 August
3,888,087 A * 6/1975 Bergsland ..... 405/36
4,045,964 A * 9/1977 Barclay ..... 405/50
4,232,092 A 11/1980 Goddard
4,309,855 A 1/1982 Pate et al.
4,381,630 A * 5/1983 Koester ..... 52/169.5
4,418,505 A 12/1983 Thompson
4,685,246 A 8/1987 Fennell
4,704,048 A 11/1987 Ahlgrimm
4,745,716 A * 5/1988 Kuypers ..... 52/169.5
4,937,990 A * 7/1990 Paquette ..... 52/199
5,035,095 A * 7/1991 Bevilacqua ..... 52/169.5
5,056,281 A * 10/1991 McCarthy ..... 52/169.5
5,157,068 A 10/1992 Chung
5,369,926 A * 12/1994 Borland ..... 52/302.1
5,511,346 A 4/1996 Kenworthy
5,581,970 A 12/1996 O'shea (Continued)

FOREIGN PATENT DOCUMENTS

CA 1220041 4/1987

*Primary Examiner* — William Gilbert
*Assistant Examiner* — James Ference
(74) *Attorney, Agent, or Firm* — Baker Botts L.L.P.

(57) ABSTRACT

An underlayment with improved drainage is disclosed. Particularly, the invention relates to an underlayment board having a first surface and a second surface, wherein the board further includes a top edge and a bottom edge and includes at least one channel defined in the first surface with each of the at least one channel extending from the top edge to the bottom edge to form a drainage path therebetween. More particularly, the underlayment board can include at least one funnel defined proximate at least the top edge or the bottom edge, wherein the at least one funnel is in fluid communication with a corresponding one of the at least one channel. A method of finishing an exterior of a structural substrate and a building assembly are also disclosed.

31 Claims, 7 Drawing Sheets

(56) References Cited

U.S. PATENT DOCUMENTS

| | | | | |
|---|---|---|---|---|
| 5,615,525 | A * | 4/1997 | Kenworthy | 52/169.5 |
| 5,704,172 | A | 1/1998 | Gougeon et al. | |
| 5,717,012 | A | 2/1998 | Bondoc et al. | |
| 5,775,039 | A * | 7/1998 | McPherson | 52/169.5 |
| 5,776,841 | A | 7/1998 | Bondoc et al. | |
| 5,822,933 | A | 10/1998 | Burroughs et al. | |
| 5,921,038 | A | 7/1999 | Burroughs et al. | |
| 5,934,828 | A * | 8/1999 | Hu et al. | 405/43 |
| 5,979,131 | A | 11/1999 | Remmele et al. | |
| 6,125,902 | A | 10/2000 | Guddal | |
| 6,145,261 | A | 11/2000 | Godfrey et al. | |
| 6,233,895 | B1 | 5/2001 | Evans et al. | |
| 6,247,874 | B1 * | 6/2001 | Hu | 405/43 |
| 6,355,333 | B1 | 3/2002 | Waggoner et al. | |
| 6,365,533 | B1 | 4/2002 | Horner, Jr. et al. | |
| 6,368,991 | B1 | 4/2002 | Horner, Jr. et al. | |
| 6,410,118 | B1 | 6/2002 | Reicherts et al. | |
| 6,449,915 | B1 * | 9/2002 | Park | 52/407.1 |
| 6,492,018 | B1 | 12/2002 | Guddal | |
| 6,551,435 | B1 | 4/2003 | LeDuc | |
| 6,584,735 | B2 | 7/2003 | Burton | |
| 6,594,965 | B2 | 7/2003 | Coulton | |
| 6,613,425 | B2 | 9/2003 | LeDuc | |
| 6,641,685 | B2 | 11/2003 | Guddal | |
| 6,684,579 | B2 * | 2/2004 | Brunson et al. | 52/169.5 |
| 6,774,071 | B2 | 8/2004 | Horner, Jr. et al. | |
| 6,786,013 | B2 | 9/2004 | Coulton | |
| 6,802,668 | B2 | 10/2004 | Parker | |
| 6,872,673 | B2 * | 3/2005 | MacAulay | 442/152 |
| 6,898,909 | B2 * | 5/2005 | Sala Prat | 52/302.4 |
| 6,990,775 | B2 * | 1/2006 | Koester | 52/302.1 |
| 2001/0054263 | A1 | 12/2001 | Coulton | |
| 2002/0012785 | A1 | 1/2002 | LeDuc | |
| 2002/0083662 | A1 | 7/2002 | Burton | |
| 2003/0032351 | A1 | 2/2003 | Horner, Jr. et al. | |
| 2003/0037499 | A1 | 2/2003 | Coulton | |
| 2003/0091812 | A1 | 5/2003 | Zubry | |
| 2003/0199217 | A1 | 10/2003 | Cashin et al. | |
| 2004/0076474 | A1 | 4/2004 | Parker | |
| 2004/0112007 | A1 | 6/2004 | Thibeau | |
| 2004/0211141 | A1 | 10/2004 | Sandy | |
| 2005/0081468 | A1 | 4/2005 | Wilson et al. | |
| 2005/0136758 | A1 | 6/2005 | Newton et al. | |
| 2005/0170147 | A1 | 8/2005 | Bacon et al. | |
| 2005/0247248 | A1 | 11/2005 | Caplan et al. | |
| 2006/0053740 | A1 | 3/2006 | Wilson et al. | |

* cited by examiner

UNDERLAYMENT WITH IMPROVED DRAINAGE

CROSS REFERENCE TO RELATED APPLICATIONS

This application claims the benefit of U.S. provisional patent application No. 60/837,106 filed on Aug. 11, 2006, the contents of which are expressly incorporated herein by reference thereto.

FIELD OF THE INVENTION

The present invention relates generally to underlayments with improved drainage. Particularly, the invention relates to an underlayment board or panel having a first surface and a second surface, wherein the board further includes a top edge, a bottom edge, and at least one channel defined in the first surface. Each of the at least one channel extends from the top edge to the bottom edge to form a drainage path therebetween. More particularly, the underlayment board can include at least one funnel defined proximate the top edge, wherein the at least one funnel is in fluid communication with a corresponding one of the at least one channel.

BACKGROUND OF THE INVENTION

The present invention relates to underlayments employed in applications such as roofing, walling, siding, or flooring, and more particularly to improved underlayments that increase the rate of water drainage by utilizing channels in the underlayment board.

The use of underlayments is well known for a variety of functions, such as thermal, noise, and air infiltration protection, moisture resistance, smooth surface creation, and hardiness. Typically, an underlayment is used to help reduce heating and cooling costs and provide a smooth, straight surface for the application of roofing, walling, foundations, siding or other exterior finish materials. The preferred application of the underlayment disclosed herein is for use as an underlayment to exterior finish materials, such as conventional siding materials, and other suitable uses where improved drainage is desired.

For new exterior finish materials applications, the underlayment boards provide a continuous air and moisture barrier for exterior finish materials such as vinyl, aluminum, steel, fiber cement, wood, or other suitable materials. For residing or existing applications, the underlayment is typically placed over the old siding to create a smooth level surface to improve installation and appearance.

Currently, at least one such underlayment is available from Pactiv Corporation under the name GreenGuard®, which is a foam board made of extruded polystyrene (XPS). Such underlayments generally known in the prior art are flat boards with substantially smooth planar surfaces.

In siding applications, the siding can be applied over the underlayment by nailing or screwing the siding into and through the underlayment and into the studs of the building. The nail or screw holes that result may allow wind blown rain to penetrate the siding. Vinyl siding may be interlocked together, but heavy rain may drive water around the joints. Additionally, other avenues of water penetration include seams or cracks along windows, doors, electrical fixtures, water faucets, weep holes and other penetrations in the sidings. Furthermore, power washing of siding or drainage systems can lead to further water penetrating the siding.

Therefore, there is a need for an underlayment having improved drainage.

SUMMARY OF THE INVENTION

The purpose and advantages of the present invention will be set forth in and apparent from the description that follows, as well as will be learned from the practice of the invention. Additional advantages of the invention will be realized and attained by the methods and systems particularly pointed out in the written description and claims hereof, as well as from the appending drawings.

To achieve these and other advantages, and in accordance with the purpose of the invention, as embodied herein and broadly described, an underlayment is provided comprising a board having a first surface and a second surface and a top edge and a bottom edge. The board further includes at least one channel defined in the first surface, and each of the at least one channel extends from the top edge to the bottom edge to form a drainage path therebetween. The top edge and the bottom edge of the underlayment board includes a support surface defined between two adjacent channels against which an adjacent underlayment board can engage.

In accordance with a further aspect of the invention, the underlayment board can include at least one funnel defined proximate the top edge, with the at least one funnel in fluid communication with a corresponding one of the at least one channel. The funnel has a first cross dimension exposed at the top edge and a second cross dimension at the channel, and the first cross dimension is greater than the second cross dimension. The funnel can have a generally trapezoidal, conical, or other suitable configuration. Preferably, the underlayment includes a plurality of funnels, where each funnel is in fluid communication with a corresponding one of the at least one channel.

In accordance with a further aspect of the invention, the underlayment board can include at least one inverted funnel defined proximate the bottom edge, with the at least one inverted funnel in fluid communication with a corresponding one of the at least one channel. The inverted funnel has a first cross dimension exposed at the bottom edge and a second cross dimension at the channel, and the first cross dimension is greater than the second cross dimension.

In accordance with a further aspect of the invention, the at least one channel can be one channel or a plurality of channels. Preferably, the at least one channel is a plurality of channels. More preferably, the plurality of channels of the underlayment board are generally spaced equally apart across a substantial portion of the first surface. In a preferred embodiment, each channel generally defines a centerline extending axially therethrough and the channels are spaced apart with the centerlines of adjacent channels being about one inch apart or less.

In accordance with a further aspect of the invention, the underlayment board has a thickness between the first surface and the second surface, and preferably each channel has a depth between about 5% and 75% of the thickness of the board and each funnel has a depth equal to or greater than the depth of the channel. More preferably, the depth of each channel can be between about 10% and 50% of the thickness of the board.

In accordance with a further aspect of the invention, the board has opposing side edges. Preferably, at least one of the opposing side edges includes an engagement surface against which a corresponding side edge of an adjacent underlayment board can be engaged. The engagement surface can be shaped to interlock with a corresponding side edge of an adjacent underlayment board.

In accordance with a further aspect of the invention, the board is a single-piece construction, such as a polymer material. The polymer material can be selected from the group consisting of polyisocyanurate foam, polyurethane foam, expanded polystyrene (EPS), extruded polystyrene (XPS), and the like. Preferably, the polymer material is extruded polystyrene.

Alternatively, the board can be a laminate including a first layer defining the first surface and a second layer defining the second surface. The first layer can be made of a material that is the same as or different than the second layer as desired.

In accordance with a further aspect of the invention, the second surface can include channels. Alternatively, the second surface is generally planar and free of channels. A film layer, such as foil, can be provided on the second surface. The first or second surface of the board can include one or more indicia, such as, but not limited to, a logo, installation instructions, or assistance graphics or grids.

In accordance with another aspect of the invention, the top edge of the board can be angled, slanted, shiplapped, or otherwise shaped to direct drainage toward the channels of the first surface. The bottom edge also can be angled, slanted, shiplapped, or otherwise shaped accordingly to mate with the top edge.

In accordance with another aspect of the invention, a building assembly comprises a structural substrate having a substantially vertical face, an underlayment, and an exterior finish material. The underlayment includes a board having a first surface and a second surface and a top edge and a bottom edge. The underlayment board further has at least one channel defined in the first surface. Each of the at least one channel extends from the top edge to the bottom edge of the board to form a drainage path therebetween. The board is disposed with the second surface facing the face of the structural substrate. The exterior finish material is secured adjacent the first surface of the underlayment board with the underlayment board sandwiched between the structural substrate and the exterior finish material. A second underlayment board of similar construction can be provided, wherein the second underlayment board has an edge disposed against at least one edge of the first underlayment board. Each underlayment board can include one or more of the features described herein.

In accordance with another aspect of the invention, a method is provided for finishing a structural substrate having a generally vertical face. The method includes providing an underlayment including a board having a first surface and a second surface, the board further including a top edge and a bottom edge. The board further has at least one channel defined in the first surface, and each of the at least one channel extends from the top edge to the bottom edge to form a drainage path therebetween. The method further includes disposing the underlayment board with the second surface facing the face of the structural substrate, and the at least one channel aligned generally vertically. The method further includes securing an exterior finish material adjacent the first surface of the underlayment board with the underlayment board sandwiched between the structural substrate and the exterior finish material. The structural substrate can be the frame of a building structure, an existing exterior finish material, a sheathing, or other conventional structure as is known.

Thus, in accordance with the present invention, an underlayment is provided with an increased rate of drainage. The improvements are achieved while maintaining an R value, as desired, as good as underlayments which do not include drainage channels. Such increased drainage can reduce water penetration to the interior of the building, as well as minimize or eliminate mold under the exterior finish material by preventing pooling of water and facilitating air circulation.

It is to be understood that both the foregoing general description and the following detailed description are exemplary and are intended to provide further explanation of the invention claimed.

The accompanying drawings, which are incorporated in and constitute part of this specification, are included to illustrate and provide further understanding of the method and system of the invention. Together with the description, the drawings serve to explain the principles of the invention.

BRIEF DESCRIPTION OF THE DRAWINGS

For a further appreciation of the above and other advantages, reference is made to the following detailed description and to the drawings, in which.

DETAILED DESCRIPTION OF THE PREFERRED EMBODIMENTS

Figure 1:
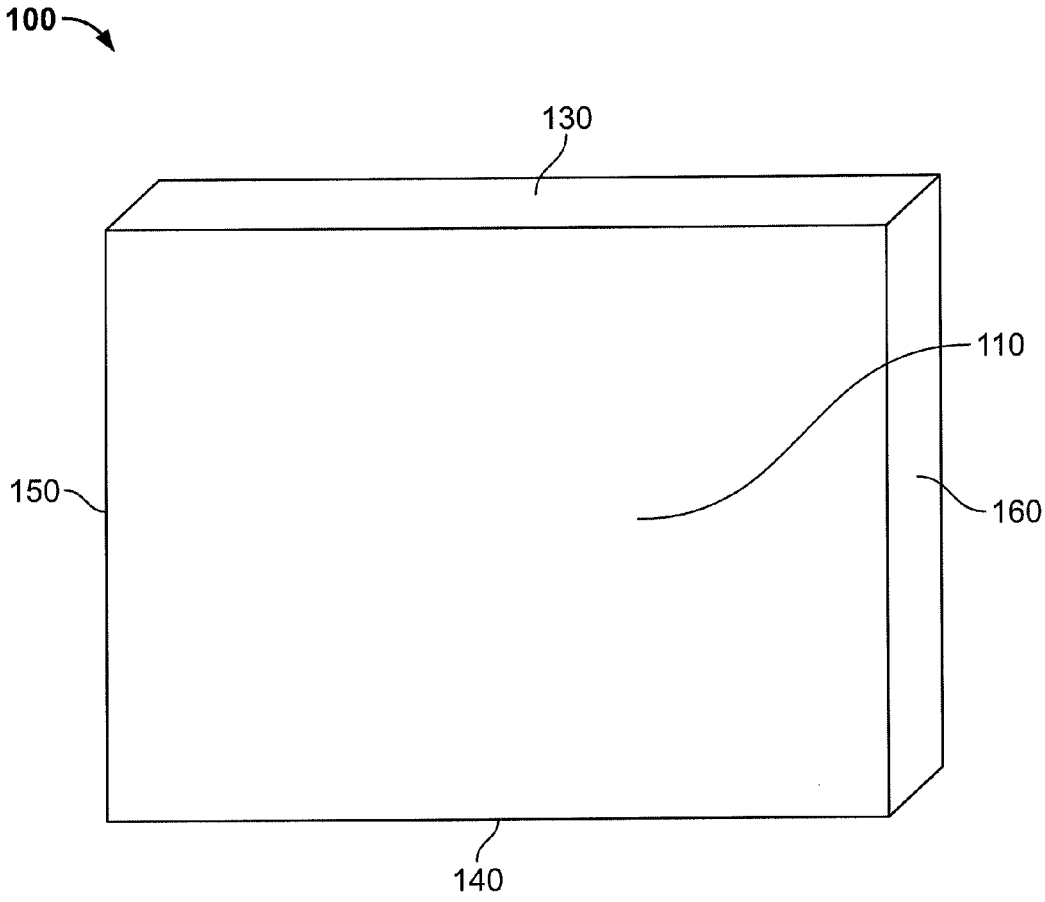
FIG. 1 (Prior Art)
FIG. 1 is a front perspective view of the prior art underlayment.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted that like components are designated by like reference numerals throughout the various figures.

Referring now to FIG. 1, an underlayment 100 of the prior art is depicted. The underlayment is a rectangular board or panel which includes a first surface 110, a second surface 120 (not shown), a top edge, a bottom edge, and opposing side edges labeled 130, 140, 150, and 160, respectively. Generally, the first and second surfaces are substantially smooth. The board can be made of any known and suitable material.

In accordance with the invention, an underlayment is provided comprising a board having a first surface and a second surface, the board further including a top edge and a bottom edge. The board further includes at least one channel defined in the first surface, and each of the at least one channel extends from the top edge to the bottom edge to form a drainage path therebetween. The top edge and the bottom edge each includes a support surface defined between two adjacent channels against which an adjacent underlayment board can engage.

Figure 2A:
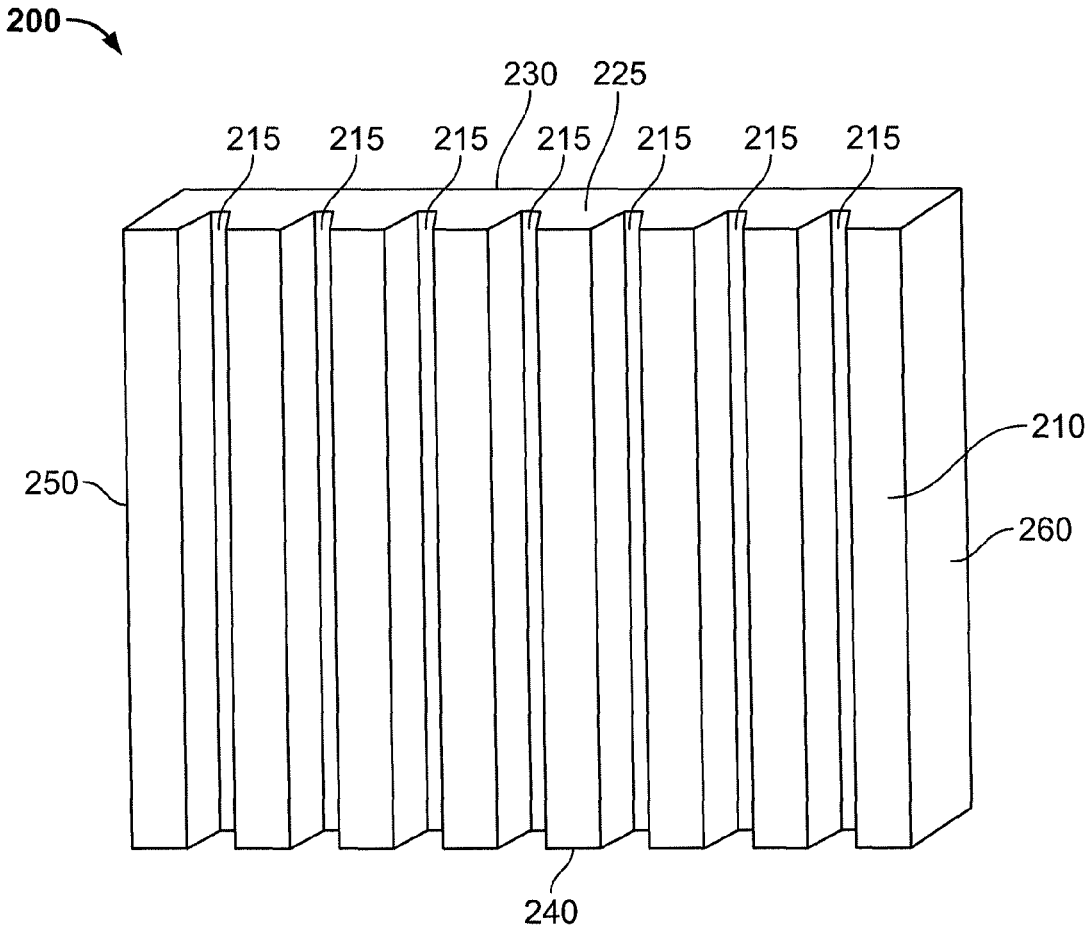
FIGS. 2*a* and 2*b* are front perspective views of embodiments of an underlayment having channels in accordance with the invention.
Figure 2B:
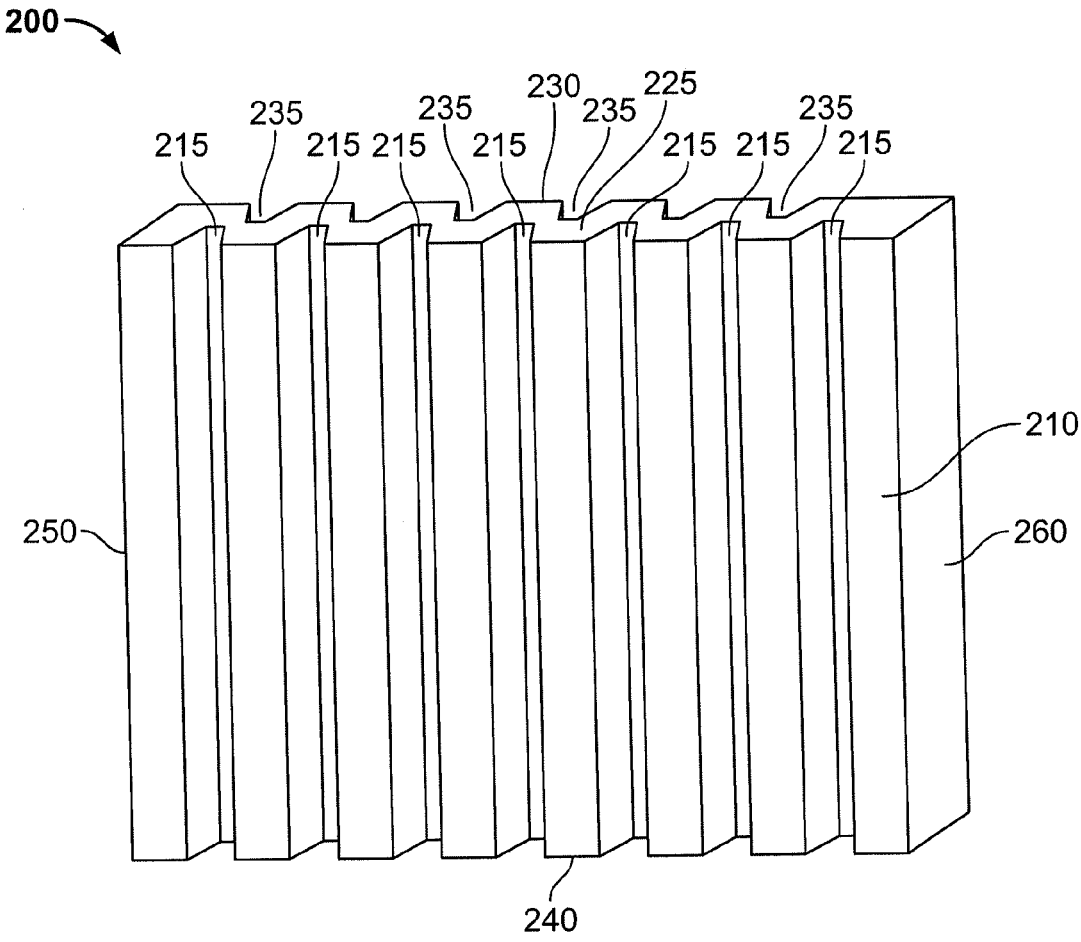

For purpose of illustration, and not limitation, reference is made to the embodiment of FIG. 2*a*. FIG. 2*a* shows an underlayment 200 having a first surface 210, a second surface 220 (not shown), a top edge 230, and a bottom edge 240. The plurality of channels 215 are defined in the first surface, wherein each channel extends from the top edge to the bottom edge to form a drainage path therebetween. A support surface 225 is defined between two adjacent channels. As shown in FIG. 2*b*, in a preferred embodiment, the second surface can include channels 235, for example when escaping interior moisture of a building is a concern. Alternatively, the second surface is generally planar and free of channels.

Figure 3A:
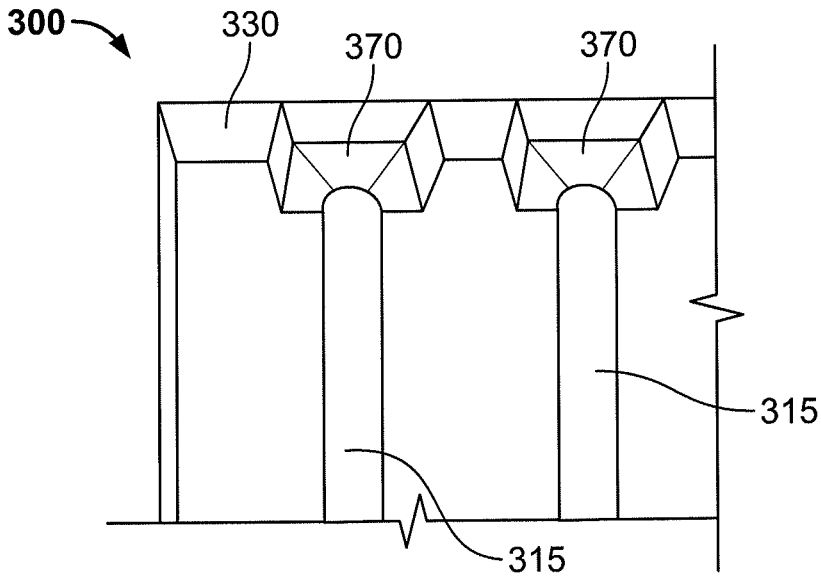
FIGS. 3*a* and 3*b* are detailed front perspective views of the top edge of embodiments of an underlayment having funnels in fluid communication with the channels in accordance with another aspect of the invention.

The channels can have any suitable configuration and alignment which results in increased drainage. For example, the channels 215 can have a polygonal or rectilinear cross section as shown in FIG. 2*a*, or in a preferred embodiment, the channels 315 (as shown in FIG. 3*a*) can have at least a partially curved or circular cross section to eliminate any sharp edges that may be difficult to form and that could result in resistance to drainage. Additionally, each groove or channel can vary in cross sections along its length, or adjacent grooves can be provided with different cross sections. Preferably, the plurality of channels 215 are aligned vertically as shown in FIG. 2*a*. The channels however, can be aligned at an angle relative to the top edge, such as diagonal. If desired, the channels can interconnect along their lengths as shown 316 in FIG. 3*b*, or the channels can be parallel and not interconnect, as shown in FIG. 2*a*. If it is desired to control or regulate the drainage rate, the channels can be varied in dimension or shape or otherwise formed to define a more tortuous drainage path to avoid water pooling or back flow.

The at least one channel can be either one channel or a plurality of channels such that the number of channels and the spacing between channels can be varied to provide desired results. For example, in a preferred embodiment, the at least one channel is a plurality of channels. More preferably, the channels can be equally spaced apart. Each channel defines a centerline extending axially therethrough, and in a preferred embodiment, the channels are equally spaced apart with the centerlines of adjacent channels being about one inch apart or less. In one preferred embodiment, the spacing is about 1". In this manner, a support surface 225 is defined between two adjacent channels. This support surface can be engaged by and support an adjacent panel of similar construction if desired. Additionally, by spacing the channels appropriately, flexibility can be introduced into the board, such that the board can be rolled prior to installation if desired.

In one preferred embodiment, the underlayment board is a single-piece construction. The underlayment 200 can be constructed from a variety of suitable materials or a combination of suitable materials. For example, the underlayment can be constructed of wood, plywood, composite particle board, oriented strand board, fiberglass-faced gypsum board, foam, expanded polystyrene (EPS—beadboard), extruded polystyrene (XPS), and any other suitable material. The preferred material is a polymer material, selected from the group consisting of polyisocyanurate foam, polyurethane foam, expanded polystyrene, and extruded polystyrene. Preferably, the polymer material is extruded polystyrene.

As depicted herein, the underlayment boards are rectangular boards which can be of any suitable dimension. For example, but without limitation, the dimensions of a single board can be between 1 to 6 foot by 2 to 10 foot. More preferably, the dimensions of a single board can be about 4' by 8'. Alternatively, the underlayment boards can be interconnected in a fanfold configuration. The fanfold configuration can be created by creasing and folding, or cutting and folding, the materials from which the board is made. In this manner, but without limitation, the dimensions of the interconnected fanfold boards can be between 1-6' by 10-80' or more. More preferably, the dimensions of the fanfold boards is about 4' by 48'. If the board is sufficiently flexible, a roll configuration can be provided for the board. The boards can be of any suitable thickness. Preferably, the underlayment boards are between ⅛" and ⅜" thick.

The first surface 210 and/or the second surface 220 can be non-faced or optionally can be covered with a coating or film. The coating or film can be applied with an adhesive or other conventional techniques. The coating can be a foil, such as a metalized polyolefin or the like. Alternatively, the coating can be a film of a variety of suitable materials or a combination of suitable materials including a polyester, nylon, fiberglass, polymer or the like. In a preferred embodiment, the first and/or second surface include a high impact polystyrene coating. The optional films and coatings can provide a vapor and radiant barrier, chemical resistance, and/or durability without substantially affecting the rate of drainage through the channels.

The use of channels, and particularly, the preferred vertical channels shown in FIG. 2*a* as 215, results in increased drainage as compared to a conventional underlayment board which does not include channels. For example, if a section of exterior finish material presses up against a conventional underlayment, it may cause water to be trapped and pooled between the surfaces. The pooling can result in water seeping toward the house through screw or nail holes in the underlayment boards or the seams of adjacent underlayment boards. The channels therefore prevent or reduce such surface contact, as well as facilitate drainage as desired. Therefore, increased drainage can reduce water penetration to the interior of the building, as well as minimize or eliminate mold under the exterior finish material by preventing pooling of water and facilitating air circulation.

Additionally, the use of vertical channels can provide vertical strength improvement for the underlayment board. Any of a variety of dimensions, spacing, and shapes can be used to define the channels and provide suitable drainage and strength. Additionally, the dimension or depth of the channel will depend on the thickness of the board. The underlayment board has a thickness between the first surface and the second surface and preferably each channel has a depth between about 5% and 75% of the thickness of the board. More preferably, the depth of each channel can be between about 10% and 50% of the thickness of the board. Therefore, the dimensions of the grooves ultimately will depend upon the board thickness and the desired drainage rate.

In a preferred embodiment, the underlayment board 200 has opposing side edges 250 and 260 that include engagement surfaces against which a corresponding side edge of an adjacent underlayment board can be engaged. Further, the opposing side edges can be shaped in any suitable configuration, such as shiplap or the like, to interlock with a corresponding side edge of an adjacent underlayment board. Additionally, opposing side edges can also include flat, recessed surfaces designed to accommodate taping of the seams, such as shown in FIG. 3*b*, which allows the underlayment installation to meet the AC71 criteria for a weather resistive barrier.

Figure 3B:
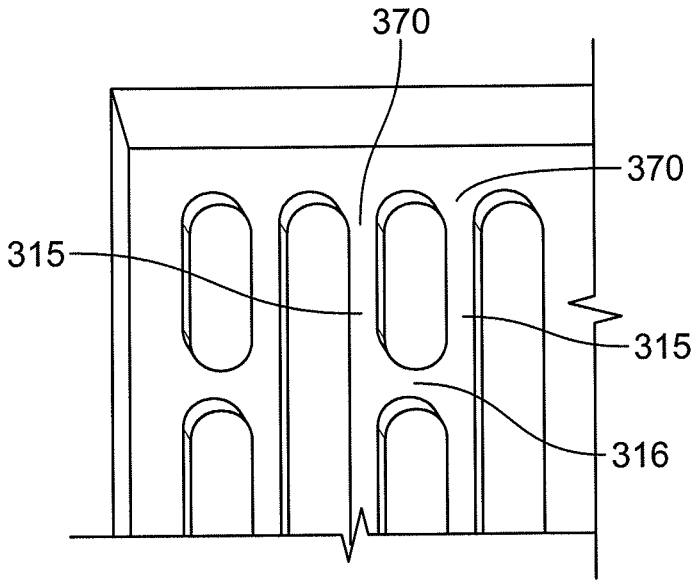

Referring now to FIGS. 3*a* and 3*b*, and in accordance with another aspect of the invention, misalignment features can be provided proximate to the top edge, the bottom edge, or both. Generally, the misalignment features allow for two underlayment boards of similar or identical construction to be positioned vertically adjacent to each other and allow for drainage there across even if the channels of the adjacent boards are not axially aligned. For example, the misalignment feature embodied herein is depicted in the form of a funnel configuration at least one end of a channel to allow fluid communication with a channel of an adjacent board. Hence, the misalignment features can have a variety of forms, configurations, or shapes suitable to facilitate drainage and account for possible misalignment of the underlayment boards during installation.

As embodied herein for illustration and not limitation, and as shown in FIG. 3*a*, funnel 370 is defined proximate the top edge 330 of the underlayment 300. Additionally, the underlayment 300 can include an inverted funnel 371 defined proximate the bottom edge 340 (not shown). Each funnel is in fluid communication with a corresponding channel 315. The funnel 370 embodied herein has a first cross dimension exposed at the top edge and a second cross dimension at the channel. Preferably the first cross dimension is greater than the second cross dimension. Likewise, the funnel 371 at the bottom edge, as embodied herein, has a first cross dimension exposed at the bottom edge and a second cross dimension at the channel. See, for example, funnel 471 in FIG. 4. Preferably, the first cross dimension is greater than the second cross dimension.

It is further preferred that the funnels, as shown in FIG. 3*a*, have a sloped surface directed toward the channel, such as a trapezoidal or conical shape or the like. Preferably, the surface along the top and/or bottom edges between the funnels are minimized without affecting the forming of the funnel or the strength of the board. This allows for increased misalignment between the channels and reduces splash when the draining water exits the bottom of the channel and funnel of one board and enters the top funnel of an adjacent board.

Preferably, the funnels have a depth equal to or greater than the depth of the channel. Hence, for example, the thickness of the backwall of the funnel can be less than ½", and more preferably less than ¼". The funnels can be formed in the same manner and simultaneous with forming the channels. In a preferred embodiment, the underlayment board can include a plurality of funnels, and more preferably, a funnel is defined proximate the top edge of each channel and an inverted funnel is defined proximate the bottom edge of each channel. This preferred embodiment eliminates the single orientation of the board because of its symmetry.

Figure 4:
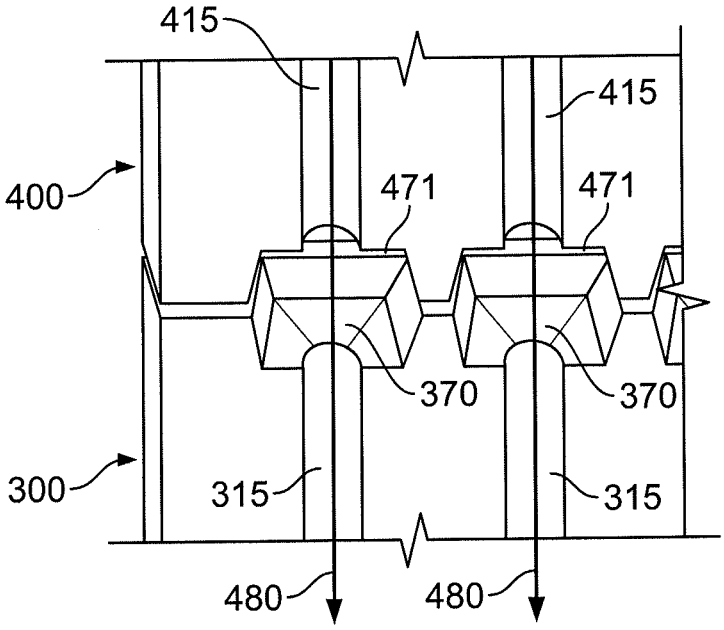
FIG. 4 is a partial front view of two adjacent underlayments of FIG. 3*a* in alignment.

For purpose of illustration, FIG. 4 shows two adjacent underlayments 300 and 400 in axial alignment in accordance with the invention. The arrow labeled 480 shows the drainage path through the drainage channel 415 and funnel 471 and into adjacent funnel 370 and channel 315.

Figure 5:
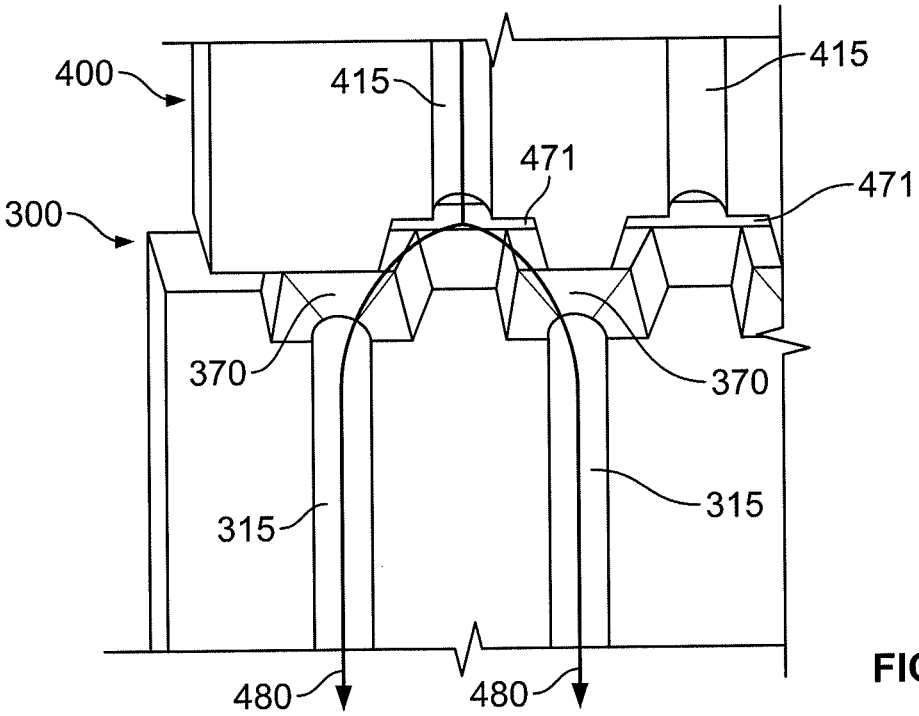
FIG. 5 is a partial front view of two adjacent underlayments of FIG. 3*a* that are not aligned.

FIG. 5 shows two adjacent underlayments 300 and 400 which are misaligned. The arrows labeled 480 show the drainage paths through the drainage channels 415 and the funnels 471 and into adjacent funnels 370 and channels 315. As can be seen in FIG. 5, it is preferable to have the edge cross dimension of the funnel greater than the spacing between the funnels such that drainage occurs from one underlayment board to the next even if the channels are out of phase or misaligned as shown.

In another embodiment, the underlayment board having a first surface and a second surface and a top edge and a bottom edge includes at least one channel defined as a microchannel or microgroove with each of the at least one channel extending from the top edge to the bottom edge to form a drainage path therebetween. Each microgroove has a reduced cross-sectional dimension as compared to the grooves previously described; a greater number of grooves are provided to facilitate similar drainage characteristics. Each microgroove defines a centerline extending axially therethrough, and in a preferred embodiment, the microgrooves are equally spaced apart with the centerlines of adjacent channels being less than about ¼" apart. The underlayment board has a thickness between the first surface and the second surface and preferably each microgroove has a depth between about 1% and 25% of the thickness of the board. Further, misalignment features can be provided proximate to the top edge, the bottom edge, or both. For example, and in a preferred embodiment, the top and/or bottom edges are angled or slanted toward the first surface to direct drainage toward the grooves. This accounts for misalignment of the channels and prevents water from seeping toward the interior of the building.

Figure 7:
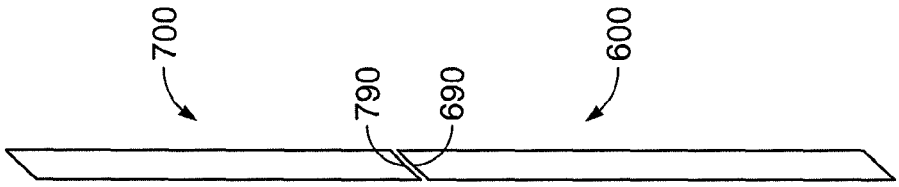
FIG. 7 is a side view of the underlayment of FIG. 6.
Figure 6:
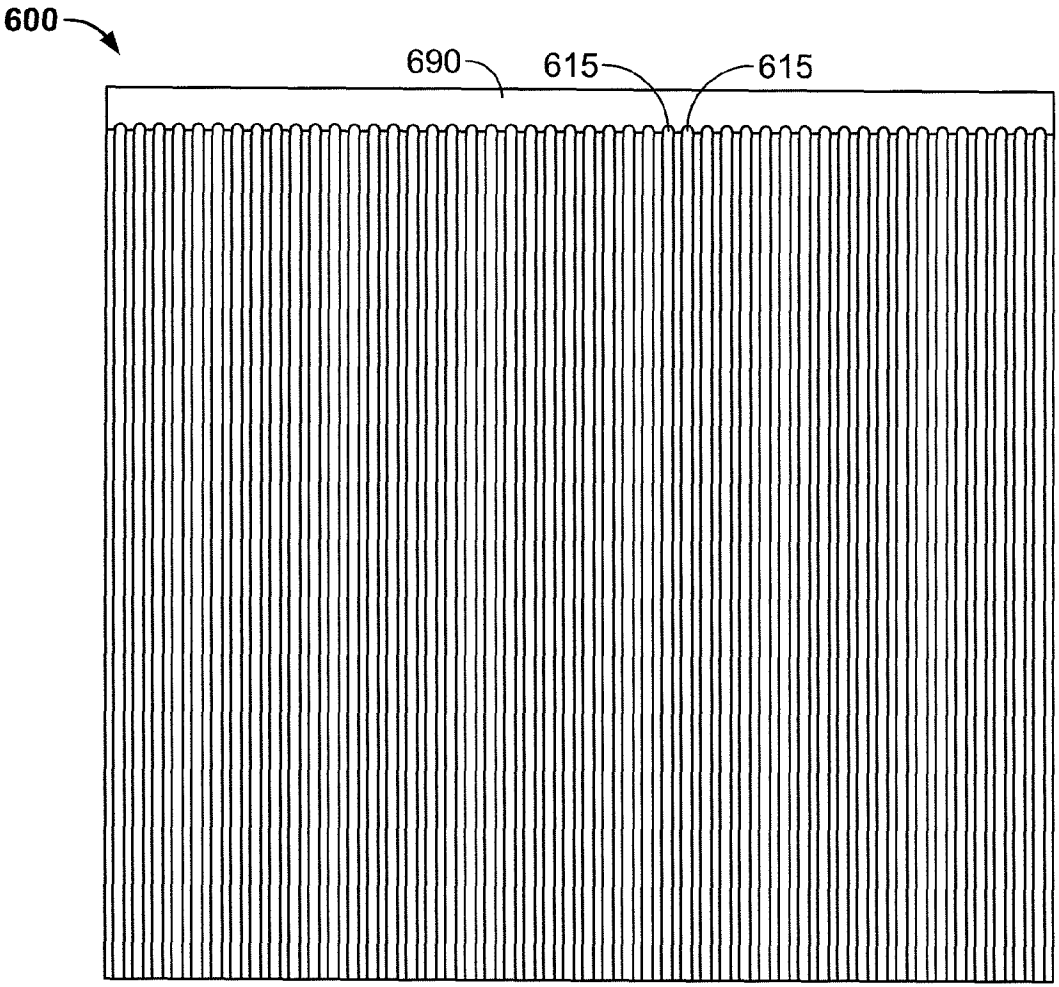
FIG. 6 is a front view of another embodiment of an underlayment having a plurality of channels and slanted top and bottom edges.

For the purpose of illustration and not limitation, FIG. 6 shows an underlayment 600 which includes microgrooves 615 and further includes a slanted top edge 690 and a bottom edge 690 (not shown). FIG. 7 shows two adjacent underlayments 600 and 700 similar to that of FIG. 6, with a slanted top edge 690 and a slanted bottom edge 790. In a preferred embodiment the top edge 690 and bottom edge 790 are slanted lap joints. When water drains to the bottom of panel 700, the slanted lap joint directs the drainage toward the first surface and thus prevents water from flowing toward the interior of the building. In this manner, the water will drain toward the first surface or the exterior of the top edge of adjacent underlayment board 600.

Any of a variety of techniques can be used for fabrication of the underlayments with grooves defined therein. For example, the underlayment board can be formed of a single piece construction by extrusion and/or subsequent process steps. That is, and by using a polymer material, the underlayment board can be extruded with grooves formed therein, using an in-line cylinder, die or the like. Alternatively, the single piece polymer board can be extruded with substantially smooth surfaces, and then the grooves can be defined by thermoforming, embossing, coining, notching, calendering or other known techniques. In a preferred embodiment, the process includes extruding a foam board, cooling the board, and then thermoforming the channels into the front surface of the foam board using a cylinder or plate pressed against the outer surface of the material to form the channels (e.g., calendering or coining process). Alternatively, the underlayment board of polymer or other suitable material, can be processed to form the grooves by removing material by using a mechanical cutter or groover (CNC) machine and other suitable known techniques. Further, in accordance with another aspect of the invention, the board can be a laminate having a first layer defining the first surface and a second layer defining the second surface. The first and second layers can be the same material, or in a preferred embodiment, are different materials. Each material can be selected to provide a particular characteristic, such as strength, vapor barrier, or the like. The grooves therefore can be formed using a technique previously described, or by laminating a material to define the desired grooves (e.g. a cloth, film, or slats) to the foam board or the film covering the foam board.

Further, in accordance with another aspect of the invention, when thermoforming the channels onto both surfaces of the foam board, the flatness of the board can be more easily maintained. In a preferred embodiment, providing similar channels on the first and second surfaces, wherein the location of the channels of the first surface are offset from the location of channels of the second surface, helps improve the flexural strength of the product versus providing the channels at the same location on the first and second surfaces. Having channels on the second surface is advantageous because when the board is installed in direct contact with a flat wall sheathing member, it allows water to drain down the second surface of the drainage underlayment board between it and the wall sheathing in the event water finds its way through the seams of the board or water leaks behind the drainage board at a window or door interface.

Further, in accordance with another aspect of the invention, and as recognized from the previous description, a method is provided for finishing an exterior of a structural substrate having a generally vertical face. The method includes providing an underlayment board having a first surface and a second surface, the board further including a top edge and a bottom edge, the board having at least one channel defined in the first surface, each of the at least one channel extending from the top edge to the bottom edge to form a drainage path therebetween, as previously described. The method further includes disposing the underlayment board with the second surface facing the face of the structural substrate, and securing an exterior finish material adjacent the first surface of the underlayment board with the underlayment board sandwiched between the structural substrate and the exterior finish material. Preferably, the at least one channel is aligned generally vertically. The structural substrate can be the frame of a building structure, a sheathing, a house wrap or a building paper, an existing exterior finish material, or the like. Two or more similar underlayment boards can be provided and positioned in adjacent locations as previously described to facilitate drainage as desired. Any known methods and techniques can be used to locate and secure the underlayment between the structural substrate and the exterior finish material, provided the first surface of the underlayment and grooves defined therein are facing the exterior finish material.

In remodeling applications, the underlayment can be applied over the existing exterior finish material. Alternatively, the existing exterior finish material and existing underlayment may be removed such that the new underlayment can be applied over the house wrap, building paper, or sheathing that remains or is applied on the frame of the building structure. In new constructions, the underlayment can be applied over the house wrap, building paper, or sheathing.

Alternatively, for new constructions, and in accordance with another aspect of the invention, the sheathing can include channels, misalignment features, and/or any of the other features described herein such that the exterior finish material can be applied directly over the sheathing without the need for a house wrap, building paper, or underlayment. The sheathing can be constructed from the same materials as the underlayment 200 listed above. Preferably, the sheathing can be formed using a different blowing agent such that it has a high R value as is known in the art. Preferably, the sheathing is ½" to 1" thick and more preferably 7/16" to 1" thick.

Further, in accordance with another aspect of the invention, and in this manner, a building assembly can be provided which includes a structural substrate having a generally vertical face, an underlayment board having a first surface and a second surface, the board further including a top edge and a bottom edge, the board having at least one channel defined in the first surface, each of the at least one channel extending from the top edge to the bottom edge to form a drainage path therebetween, and an exterior finish material secured adjacent the first surface of the underlayment board with the underlayment board sandwiched between the structural substrate and the exterior finish material. The building assembly can further include a second underlayment board of similar construction having an edge disposed against an edge of the first underlayment board as previously described. Each underlayment board of the building assembly includes one or more of the features previously described herein. In one embodiment, the channels of the adjacent boards are in alignment. In another embodiment, the adjacent boards can be out of alignment, yet still facilitate drainage along the first surface.

Figure 8:
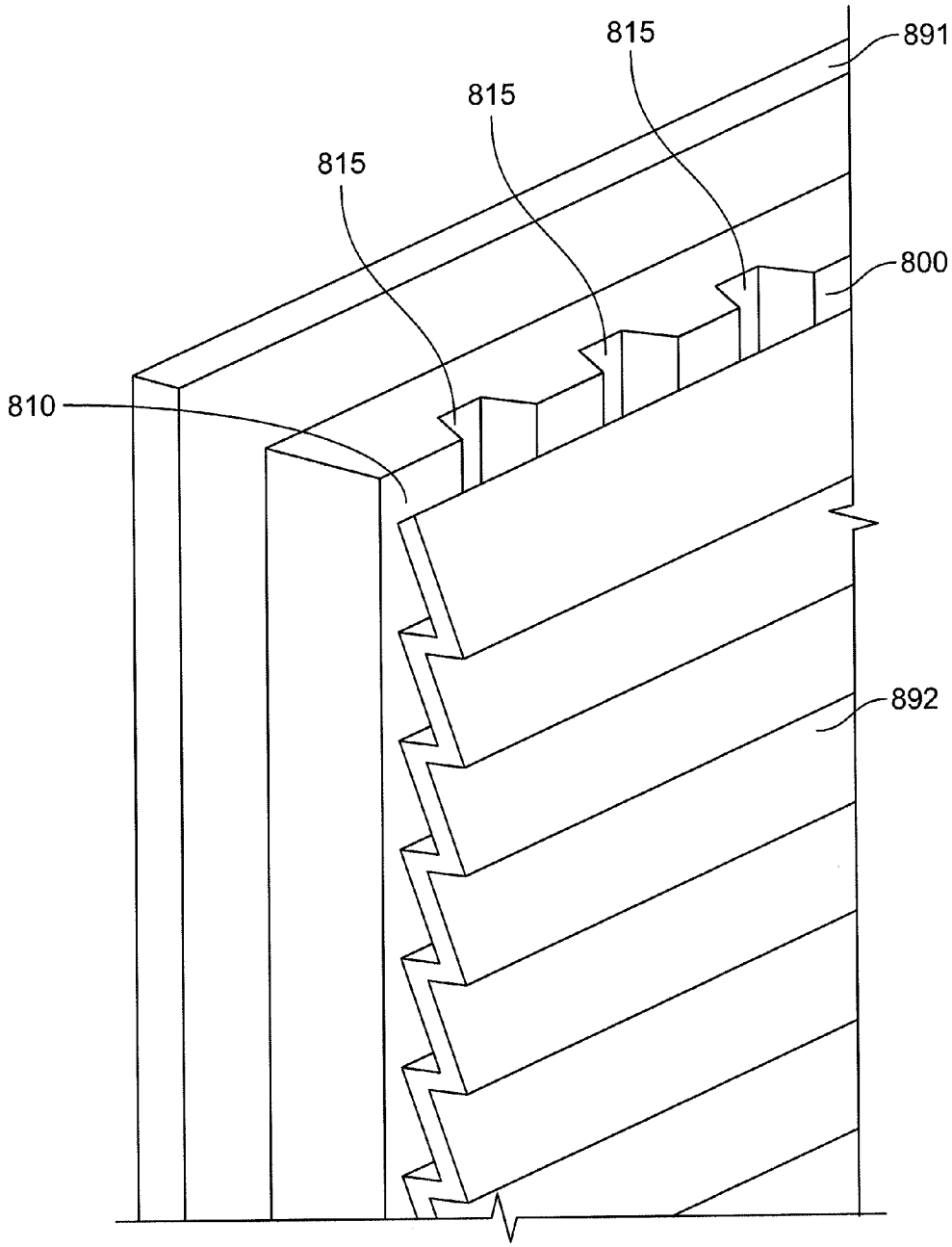
FIG. 8 is a side perspective view of one embodiment of a building assembly having an underlayment with channels in accordance with the invention.

As embodied herein for illustration and not limitation, and as shown in FIG. 8, a building assembly is depicted. The building assembly includes a structural substrate 891 having a generally vertical face, an underlayment board 800, and an exterior finish material 892. The underlayment board 800 is sandwiched between the structural substrate 891 and the exterior finish material 892 such that the first surface 810 of the underlayment board 800 including a plurality of channels 815 faces the exterior finish material 892. The structural substrate may be the frame of a building structure, a sheathing, a house wrap or a building paper, an existing exterior finish material, or the like.

The underlayments can also be provided with at least one indicia such as, but not limited to, a logo, installation instructions, or assistance graphics or grids printed on the first and/or second surface of the board. Most professional installers try to use as much of the underlayment material as possible, including scraps that were cut in covering another portion of the building, so the scraps can fit in such a way that the logo is upside-down, but this is not a problem as the channels are vertical and include funnels at both the top and bottom of the channels. Additionally, the underlayment material (e.g., scrap material) can be installed at an angle.

It will be seen from the foregoing that the present invention provides an underlayment board with improved drainage. Although a number of specific embodiments of the invention above have been illustrated, various modifications thereof will be apparent to those skilled in the art within the spirit of the invention. Accordingly, it will be evident that the scope of the invention is to be limited only as set forth in the appended claims.

What is claimed is:

1. An underlayment for exterior finish material, the underlayment comprising:

a board having a first surface and a second surface, the board further including a top edge and a bottom edge;

at least one channel defined in the first surface, each of the at least one channel extending from proximate the top edge to proximate the bottom edge to form a drainage path therebetween; and at least one funnel defined proximate the top edge, the at least one funnel in fluid communication with a corresponding one of the at least one channel.

2. The underlayment of claim 1, wherein the top edge and the bottom edge each includes a support surface defined between two adjacent channels against which an adjacent underlayment board can engage.

3. The underlayment of claim 1, wherein the funnel has a first cross dimension exposed at the top edge and a second cross dimension at the channel, the first cross dimension being greater than the second cross dimension.

4. The underlayment of claim 1, including a plurality of funnels, each funnel in fluid communication with a corresponding one of the at least one channel.

5. The underlayment of claim 1, further comprising at least one inverted funnel defined proximate the bottom edge, the at least one inverted funnel in fluid communication with a corresponding one of the at least one channel, the inverted funnel having a first cross dimension exposed at the bottom edge and a second cross dimension at the channel, the first cross dimension greater than the second cross dimension.

6. The underlayment of claim 1, the board having a thickness between the first surface and the second surface; each of the at least one channel having a depth between about 5% and 75% of the thickness of the board.

7. The underlayment of claim 1, wherein the board is a single-piece construction.

8. The underlayment of claim 1, wherein the board is made of a polymer material.

9. The underlayment of claim 8, wherein the polymer material is selected from the group consisting of polyisocyanurate foam, polyurethane foam, expanded polystyrene, and extruded polystyrene.

10. The underlayment of claim 9, wherein the polymer material is extruded polystyrene.

11. The underlayment of claim 1, wherein the board is a laminate including a first layer defining the first surface and a second layer defining the second surface.

12. The underlayment of claim 1, wherein the second surface includes at least one channel defined in the second surface, each of the at least one channel extending from the top edge to the bottom edge to form a drainage path therebetween.

13. The underlayment of claim 1, wherein the second surface is generally planar and free of channels.

14. The underlayment of claim 13, further comprising a film layer on the second surface.

15. The underlayment of claim 1, wherein at least one of the top and bottom edges is angled toward the first surface.

16. The underlayment of claim 1, wherein the at least one channel is a plurality of channels and wherein each channel interconnects with its adjacent channels.

17. A building assembly comprising:

a structural substrate having a generally vertical face;

an underlayment including a board having a first surface and a second surface, the board further including a top edge and a bottom edge, the board having at least one channel defined in the first surface, each of the at least one channel extending from proximate the top edge to proximate the bottom edge to form a drainage path therebetween, the board further having at least one funnel defined proximate the top edge, the at least one funnel in fluid communication with a corresponding one of the at least one channel, the board disposed with the second surface facing the face of the structural substrate; and an exterior finish material secured adjacent and substantially covering the first surface of the underlayment board with the underlayment board sandwiched between the structural substrate and the exterior finish material.

18. The building assembly of claim 17, wherein the top edge and the bottom edge of the underlayment board each includes a support surface defined between two adjacent channels against which an adjacent underlayment board can engage.

19. The building assembly of claim 17, wherein the underlayment board further includes at least one inverted funnel defined proximate the bottom edge, the at least one inverted funnel in fluid communication with a corresponding one of the at least one channel, the inverted funnel having a first cross dimension exposed at the bottom edge and a second cross dimension at the channel, the first cross dimension greater than the second cross dimension.

20. The building assembly of claim 17, further having opposing side edges, wherein at least one of the opposing side edges of the underlayment board includes an engagement surface against which a corresponding side edge of an adjacent underlayment board can be engaged.

21. The building assembly of claim 20, wherein the engagement surface is shaped to interlock with a corresponding side edge of an adjacent underlayment board.

22. The building assembly of claim 17, wherein the second surface of the underlayment board is generally planar and free of channels.

23. The building assembly of claim 17, wherein the at least one channel is a plurality of channels and wherein each channel interconnects with its adjacent channels.

24. The building assembly of claim 17, wherein the underlayment board further includes a film layer on the first surface.

25. The building assembly of claim 17, further comprising a second underlayment board of similar construction, the second underlayment board having an edge disposed against at least one edge of the first underlayment board.

26. The building assembly of claim 17, wherein the second surface of the underlayment board includes at least one channel defined in the second surface, each of the at least one channel extending from the top edge to the bottom edge to form a drainage path therebetween.

27. A method of finishing an exterior of a structural substrate having a generally vertical face comprising:

providing an underlayment including a board having a first surface and a second surface, the board further including a top edge and a bottom edge, the board having at least one channel defined in the first surface, each of the at least one channel extending from proximate the top edge to proximate the bottom edge to form a drainage path therebetween, the board further having at least one funnel defined proximate the top edge, the at least one funnel in fluid communication with a corresponding one of the at least one channel, disposing the underlayment board with the second surface facing the face of the structural substrate, the at least one channel being aligned generally vertically; and securing an exterior finish material adjacent and substantially covering the first surface of the underlayment board with the underlayment board sandwiched between the structural substrate and the exterior finish material.

28. The method of finishing an exterior of a structural substrate of claim 27, wherein the structural substrate is the frame of a building structure.

29. The method of finishing an exterior of a structural substrate of claim 27, wherein the structural substrate is a sheathing.

30. The method of finishing an exterior of a structural substrate of claim 27, wherein the structural substrate is an existing exterior finish material.

31. The method of finishing an exterior of a structural substrate of claim 27, wherein the second surface of the underlayment board includes at least one channel defined in the second surface, each of the at least one channel extending from the top edge to the bottom edge to form a drainage path therebetween.

* * * * *